US007852269B2

(12) United States Patent
Tsutsui et al.

(10) Patent No.: US 7,852,269 B2
(45) Date of Patent: Dec. 14, 2010

(54) ULTRAWIDEBAND COMMUNICATION ANTENNA

(75) Inventors: Kazuhisa Tsutsui, Nagoya (JP); Yoshifumi Matui, Nagoya (JP); Akihiko Saito, Nagoya (JP); Mikiko Fukase, Nagoya (JP); Takahiro Aoyagi, Tokyo (JP)

(73) Assignees: Daido Tokushuko Kabushiki Kaisha, Nagoya-shi, Aichi (JP); Tokyo Institute of Technology, Tokyo (JP)

( * ) Notice: Subject to any disclaimer, the term of this patent is extended or adjusted under 35 U.S.C. 154(b) by 130 days.

(21) Appl. No.: 11/882,766

(22) Filed: Aug. 6, 2007

(65) Prior Publication Data

US 2008/0143634 A1 Jun. 19, 2008

(30) Foreign Application Priority Data

Aug. 9, 2006 (JP) ..... 2006-217588
Feb. 24, 2007 (JP) ..... 2007-044784
May 11, 2007 (JP) ..... 2007-127299

(51) Int. Cl.
*H01Q 1/38* (2006.01)

(52) U.S. Cl. ..... 343/700 MS; 343/872; 343/873

(58) Field of Classification Search ..... 343/700 MS, 343/872, 873
See application file for complete search history.

(56) References Cited

U.S. PATENT DOCUMENTS 3,211,584 A * 10/1965 Ehrreich ..... 343/912
5,936,593 A * 8/1999 Mandai et al. ..... 343/895
6,346,913 B1 * 2/2002 Chang et al. ..... 343/700 MS
7,106,256 B2 * 9/2006 Watanabe et al. ..... 343/700 MS
2004/0090366 A1 * 5/2004 Wong et al. ..... 343/700 MS
2004/0174318 A1 9/2004 Aisenbrey ..... 343/897
2004/0196192 A1 * 10/2004 Boyd et al. ..... 343/700 MS
2004/0227688 A1 11/2004 Aisenbrey ..... 343/873

FOREIGN PATENT DOCUMENTS

EP 777297 A1 * 6/1997
JP 60-127366 7/1985
JP 2002-217897 8/2005

OTHER PUBLICATIONS

Fujitsu Kabushiki Kaisha Electronic Device Division, "FIND", vol. 23, No. 1, Jan. 2005 pp. 32-35, Japan.
Fujitsu Kabushiki Kaisha Electronic Device Division, "Uwb Ring Filter and Plane Antenna", "FIND", vol. 23, No. 1, Jan. 2005 pp. 37-42, Japan.
Aoyagi et al, "Small Resinous UWB Chip Antenna Using Metal Powder", ICUWB 2007, IEEE International Conference of Ultra-wideband, Sep. 24, 2007-Sep. 26, 2007, pp. 692-695.

* cited by examiner

*Primary Examiner*—Douglas W Owens
*Assistant Examiner*—Dieu Hien T Duong
(74) *Attorney, Agent, or Firm*—Bacon & Thomas PLLC

(57) ABSTRACT

According to the ultrawideband communication antenna, since surfaces of the antenna element are coated with the first resin layer and the second resin layer each of which is mixed with the nonmagnetic metal powder and has an insulating property and a high specific inductive capacity, the size is largely reduced. Further, since the nonmagnetic metal powder is used, the first resin layer and the second resin layer are free from a loss of magnetism generated therein, thereby enabling to maintain a loss of the antenna to a low level.

15 Claims, 9 Drawing Sheets

ULTRAWIDEBAND COMMUNICATION ANTENNA

FIELD OF THE INVENTION

This invention relates to an ultrawideband communication antenna to be used in an ultrawideband (UWB).

BACKGROUND OF THE INVENTION

Communication using the UWB is a communication method utilizing 20% of a central frequency or a band of 500 MHz or more which is a remarkably wide band ranging from several hundreds of megahertzes to several gigahertzes. Since an output is lower than a noise level of a personal computer, the communication method has various advantages such as capability of sharing with a currently used frequency, capability of high speed communication, applicable to positioning and distance measurement, and simple structure of impulse type circuit without using a carrier wave. Therefore, use of the communication method is expected to be expanded in various fields in near future.

Since the UWB uses the considerably wide band, an antenna using an ultrawideband that has not been utilized in the art, such as that having a full band of 3.1 to 10.6 GHz, a high band of 5 to 10.6 GHz, and a low band of 3.1 to 5 GHz, is required. Such ultrawideband antenna is disclosed in a reference 1 and reference 2.

[Reference 1] Technical Information Magazine "FIND" (vol. 23, No. 1); pages 32 to 35; published on January, 2005 by Fujitsu Kabushiki Kaisha Electronic Device Division.

[Reference 2] JP-A-2002-217897

Since the ultrawideband antenna disclosed on page 35 of the reference 1 and the ultrawideband antenna disclosed in paragraphs [0065] to [0069] and FIGS. 22 and 23 of the reference 2 are flat antenna type, these ultrawideband antennas are not sufficiently downsized though they are reduced in thickness, thereby raising a drawback of limited application. For example, the flat ultrawideband antenna disclosed on page 35 of reference 1 requires a length and a width of 30 mm×40 mm.

As a countermeasure for such drawback, it is considered that downsizing can be achieved by covering a periphery of an antenna element with ceramics having a high complex relative permittivity or by covering a periphery of an antenna element with a resin. The countermeasures take advantage of compression of a wavelength of an electromagnetic wave due to the high complex relative permittivity of the ceramics and the resin. However, in the case of covering the periphery of the antenna element with the ceramics, there are problems of high price and reduced resistance to impact. Also, since it is difficult to obtain a resin of high complex relative permittivity in the case of covering the periphery of the antenna element with the resin, there is a problem that satisfactory downsizing has not been achieved yet. Further, the high complex relative permittivity is considered to be achieved by mixing a magnetic powder with the resin. However, losses of inductive capacity and magnetism will be increased due to the magnetic powder, thereby undesirably causing deterioration in antenna characteristics.

This invention has been accomplished in view of the above-described circumstances, and an object thereof is to provide an ultrawideband communication antenna that is resistant to impact, reduced in losses, and satisfactorily small.

SUMMARY OF THE INVENTION

According to an aspect of the invention, there is provided an ultrawideband communication antenna including an antenna element of which at least one part is coated with an insulating resin layer that is mixed with a nonmagnetic metal powder.

Figure 1:
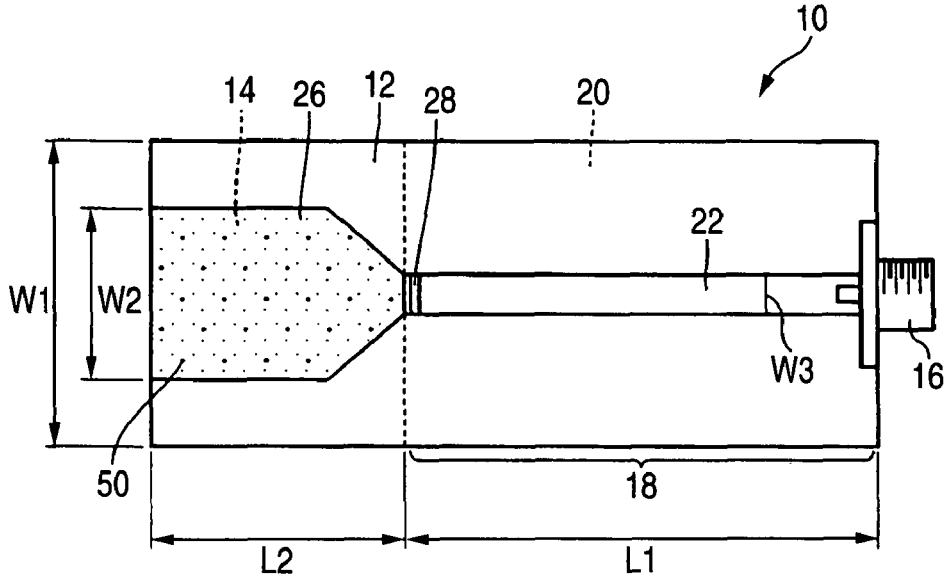
FIG. 1 is a plan view showing an ultrawideband communication antenna according to one embodiment of this invention.

The reference numerals used in the drawings denote the followings, respectively:

10: ultrawideband communication antenna (antenna)
14: antenna element
24: first resin layer (resin layer)
26 second resin layer (resin layer)
50: nonmagnetic metal powder
72 injection molding die (die)

DETAILED DESCRIPTION OF THE INVENTION

Hereinafter, an antenna to be used for ultrawideband communication system according to one embodiment of this invention will be described using the drawings.

Figure 2:
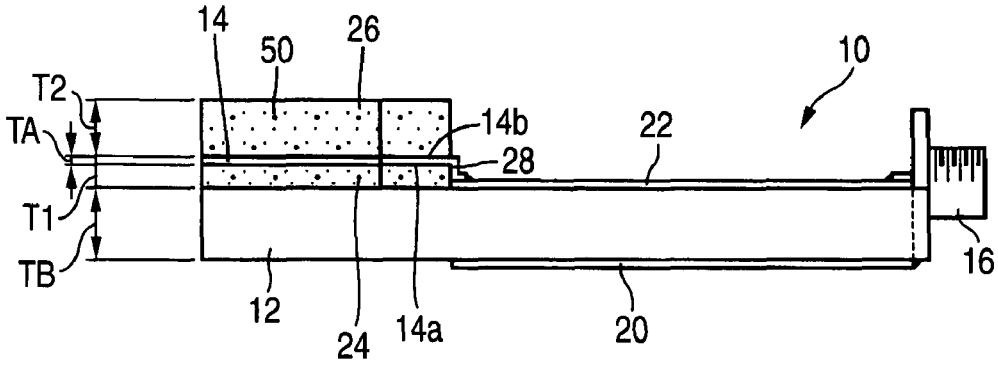
FIG. 2 is a side view showing the ultrawideband communication antenna according to one embodiment of this invention.

FIG. 1 is a plan view showing a flat antenna (monopole type; hereinafter simply referred to as antenna) 10 to be used for ultrawideband communication, and FIG. 2 is a side view showing the antenna 10. In the antenna 10 of FIGS. 1 and 2, an antenna element 14 is fixed to one end of a rectangular substrate 12, and an SMA connector 16 is provided at the other end of the substrate 12 for connecting a coaxial cable. The antenna element 14 and the SMA connector 16 are connected by a microstrip line 18. In a part of the substrate 12 between the antenna element 14 and the SMA connector 16, a planar GND conductor 20 having a width same as a width W1 of the substrate 12 and a line-like conductor 22 having a width W3 that is smaller than the width W1 are fixed to a rear surface and a front surface of the substrate 12, and the GND conductor 20 and the line-like conductor 22 form a waveguide, i.e. the microstrip line, having a predetermined length of L1. The substrate 12 is formed from a glass epoxy plate which is an epoxy resin plate reinforced by a glass fiber, for example, and the antenna element 14, the GND conductor 20, and the line-like conductor 22 are formed from a plate-like conductor such as a copper plate.

Both sides of the antenna element 14, i.e. the surface 14*a* of the antenna 14 close to the substrate 12 and the surface 14*b* of the antenna element 14 which is the reverse side of the surface 14*a*, are coated with a first resin layer (resin layer) 24 and a second resin layer (resin layer) 26 each having a constant thickness, and the antenna element 14 is fixed to the surface of the substrate 12 via the first resin layer 24. The antenna element 14 has a width W2 which is smaller than the width W1 of the substrate 12 and larger than the width W3 of the line-like conductor 22, and the length L2 shorter than the length L1. A part of the width of the antenna element 14 close to the line-like conductor 22 is tapered along a direction toward a power supply unit 28, so that an overall shape is like a pentagon.

One end of the line-like conductor 22 is connected to the power supply unit 28 by soldering, and a terminal of the SMA connector 16 is connected to the other end of the line-like connector 22, so that power is supplied from a coaxial cable connector (not shown) connected to the SMA connector 16 to the antenna element 14 via the SMA connector 16 and the line-like conductor 22.

In this embodiment: the substrate 12 has a length (L1+L2) of 31 mm, the width W1 of 10 mm, and a thickness TB of 1.6 mm; the line-like conductor 22 has a length L1 of 22 mm; the antenna element 14 has a length L2 of 9 mm, the width W2 of 5.6 mm, and a thickness TA of 0.1 mm; the first resin layer 24 has a thickness T1 of 0.3 mm; and the second resin layer 26 has a thickness T2 of 1 mm.

Figure 3:
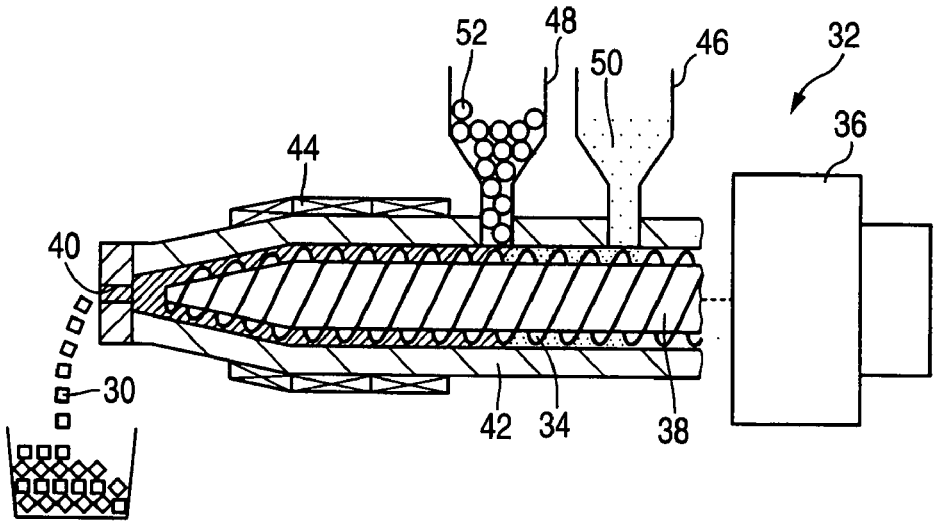
FIG. 3 is an illustration of a major structure of a raw material pelletizing machine for obtaining raw material pellets used as a molding material for a first resin layer and a second resin layer of embodiment of FIG. 1.

The first resin layer 24 and the second resin layer 26 are subjected to the injection molding together with the antenna element 14 that has been placed in a die in advance of the injection molding. FIG. 3 is an illustration of a raw material pelletizing machine 32 for obtaining raw material pellets 30 to be used for the injection molding and a raw material pelletizing process, and FIG. 4 is an illustration of an injection molding machine for injection molding the first resin layer 24 and the second resin layer 26 and the injection molding process.

The row material pelletizing machine 32 shown in FIG. 3 has a spiral fin 34 provided on its outer periphery, a screw shaft 38 rotatably driven by a driving device 36, and a nozzle 40 disposed at its tip and is provided with a cylindrical barrel 42 for housing the screw shaft 38 at a concentric position, a heater 44 wound around an outer periphery of the barrel 42, a metal powder hopper 46 attached to the barrel 42 for supplying a material to the barrel 42, and a resin pellet hopper 48. In The thus-structured material pelletizing machine 32, a nonmagnetic metal powder 50 inside the metal powder hopper 46 and resin pellets 52 inside the resin pellet hopper 48 are supplied to the barrel 42 at a predetermined ratio. The resin pellets 52 are heated to about 300° C. by the heater 44 to be in a melted state and mixed uniformly with the nonmagnetic metal powder 50 in the course of transfer to the nozzle 40 by the screw shaft 38. After that, the resin in the melted state and mixed with the nonmagnetic metal powder 50 is extruded continuously from the nozzle 40. The extruded resin in the melted state is rapidly solidified and cut into pellets by a cutter (not shown) in the course of solidification to be the raw material pellets 30. A composition of the raw material pellets 30 is the same as the first resin 24 and the second resin 26, wherein the nonmagnetic metal powder 50 is mixed uniformly with a polyphenylene sulfide resin, for example, at a ratio of 10 to 50 vol %.

The nonmagnetic metal powder 50 is palletized by employing a well-known metal powder production method such as a gas atomizing method, a water atomizing method, and a gas-water atomizing method to achieve the average particle diameter of D50 ranging from about 3 to about 100 μm. In the gas atomizing method, in a cylindrical chamber disposed vertically, a melted raw material is dropped from pores formed on a bottom of a tundish provided at an upper end of the chamber, and an inactive gas is sprayed in the form of a taper around the melted material toward the melted raw material during the dropping to granulate and coagulate the melted material. After that, a metal powder having a desired average particle diameter is obtained by classification from collected metal particles. In the case of employing the gas atomizing method, a relatively spherical metal powder is obtained. In the water atomizing method, in a chamber in which water is stored, a melted raw material is dropped from pores formed on a bottom of a tundish provided at an upper end of the chamber, and a high pressure water is sprayed in the form of a taper around the melted material by using a circular nozzle toward the melted raw material during the dropping to granulate and coagulating the melted material. After drying collected metal particles, a metal powder having a desired average particle diameter is obtained by classification from the collected metal particles. In the case of employing the water atomizing method, a relatively flat metal powder is obtained. In the gas-water atomizing method, a metal powder is obtained in the same manner as in the water atomizing method except for changing the high pressure water to an inactive gas.

Figure 4:
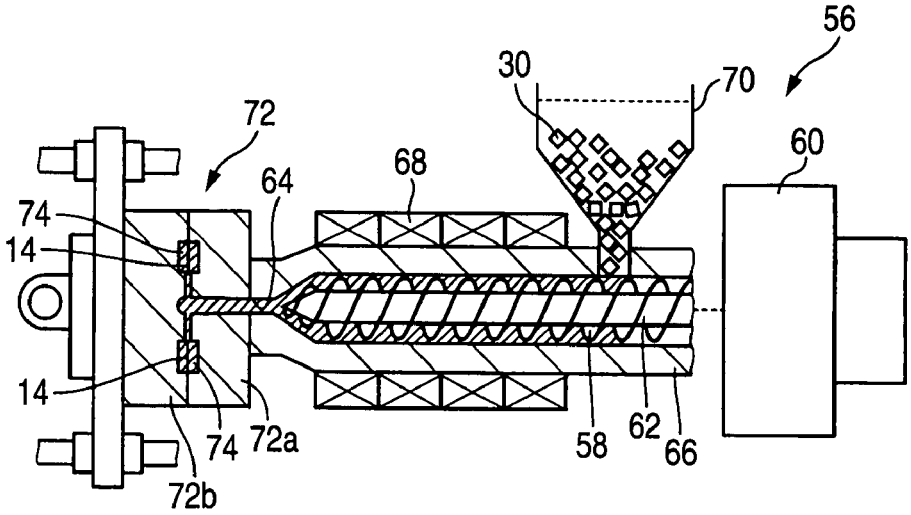
FIG. 4 is an illustration of a major structure of an injection molding machine for injection-molding the first resin layer and the second resin layer of the embodiment of FIG. 1.

The injection molding machine 56 shown in FIG. 4 has a spiral fin 58 provided on its outer periphery, a screw shaft 62 rotatably driven by a driving device 60, and an injection nozzle 64 disposed at its tip and is provided with a cylindrical barrel 66 for housing the screw shaft 62 at a concentric position, a heater 68 wound around an outer periphery of the barrel 66, and a raw material pellet hopper 70 attached to the barrel 66 for supplying the raw material 30 to the barrel 66. An injection molding die (die) 72 which is opened/closed by an open/close mechanism (not shown) formed of a toggle mechanism or the like is fixed to the tip of the barrel 66. The injection molding die 72 is formed of a pair of fixing die 72*a* and a movable die 72*b* that are combined with each other, and a molding cavity (molding space) 74 for injection-molding the first resin layer 24 and the second resin layer 26 is formed on combining surfaces of the fixing die 72*a* and the movable die 72*b*. In the thus-structured injection molding machine 56, when the raw material pellets 30 inside the raw material pellet hopper 70 are supplied to the barrel 66 at a predetermined ratio and transferred to the injection nozzle 64 by the screw shaft 62, the raw material pellets 30 are heated to about 300° C. by the heater 68 to be in a melted state, and the melted raw material is injected from the injection nozzle 64. In the molding cavity 74 inside the injection molding die 72, the antenna element 14 is placed in advance of the injection molding at a predetermined position, and, after the melted raw material is charged into the molding cavity 74 via the injection nozzle 64, the raw material is solidified by cooling to be released from the movable die 72*b* and the fixing die 72*a*, thereby giving the antenna element 14 on whose surfaces the first resin layer 24 and the second resin layer 26 are fixed by the molding. That is, the antenna element 14 of which the surfaces are covered with the first resin layer 24 and the second resin layer 26 as shown in FIGS. 1 and 2 are obtained.

DESCRIPTION OF EXEMPLARY EMBODIMENTS

Hereinafter, evaluation tests wherein various materials were used as the nonmagnetic metal powder and a mixing ratio of the nonmagnetic metal powder was changed are shown together with the results.

Test Example 1

In Test Example 1, antenna samples 10*a* and 10*b* were obtained in the same manner as in the case of obtaining the antenna 10 described in the foregoing except for using materials shown in Table 1 for the first resin layer 24 and the second resin layer 26. Referring to Tables 1 to 4, each of the complex specific inductive capacities was measured by using a measurement frequency of 4 GHz. Also, a value of an added amount of each of materials (metal components) shown in Tables 1 and 2 is based on wt % (% by weight).

TABLE 1

| | Resin layer of antenna sample 10a | Resin layer of antenna sample 10b |
|---|---|---|
| Metal powder component | Ni—3.5Fe—3.5B—3Mo—3Cu—3.8Si—0.5C | Fe—13Cr |
| Magnetism of metal powder | Nonmagnetic | Magnetic |
| Volumetric charge ratio | 30% | 30% |
| Metal powder production method | Gas atomizing method | Gas-water atomizing method |
| Shape of metal powder | Spherical | Flat |
| Average particle diameter | 50 μm | 9 μm |
| Resin | PPS resin | PPS resin |
| Complex relative permittivity (4 GHz) | 8.4 | 10.1 |
| tan δ (=μ''/μ') | 0 | 0.5 |
| tan δ (=ε''/ε') | 0.02 | 0.07 |

Figure 5:
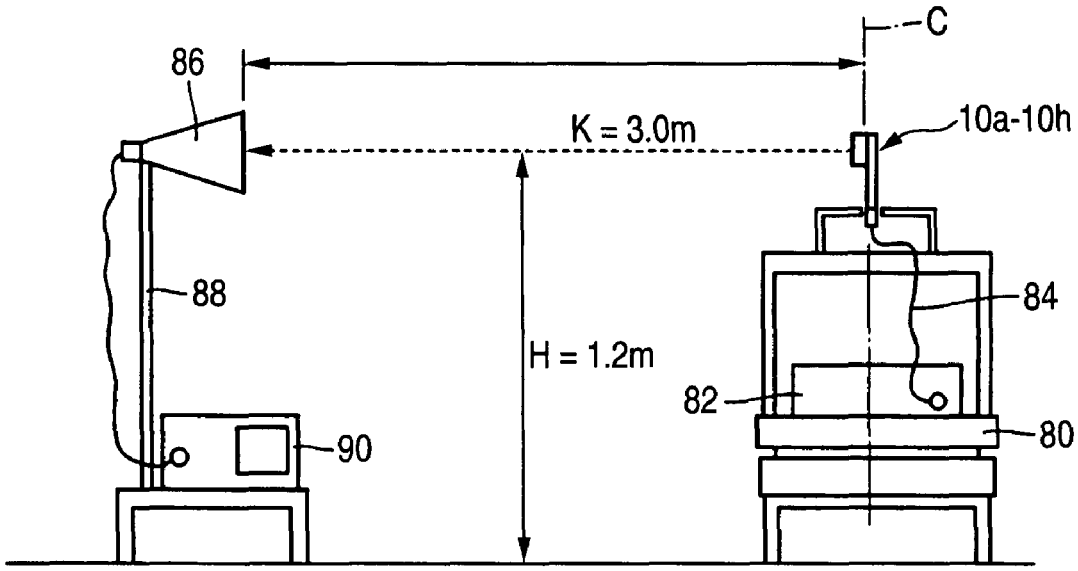
FIG. 5 is an illustration of a structure of a measurement apparatus used in Test Examples 1 and 4.

As shown in FIG. 5, on a turn table 80 rotatable around a vertical axis C, the antenna sample 10*a* or the antenna sample 10*b* was placed along the vertical axis C upright at a position H which is 1.2 m from the ground, and a signal having an intensity of −4 dBm and a frequency of 4 GHz was supplied to the antenna 10*a* (10*b*) from a transmitter (E4422B type: product of Agilent Technologies) 82 via a coaxial cable 84 to cause the antenna 10*a* or 10*b* to radiate a signal. Next, a horn antenna 86 for detection was supported by a column 88 at a position distant from the vertical axis by 3 m, and an intensity (dBm) of the signal received by the horn antenna 86 was measured by using a spectrum analyzer (8565E type: product of Agilent Technologies) 90. The antenna 10 was rotated about the vertical axis C in increments of 10 degrees to repeat the measurement every 10 degrees.

Figure 6:
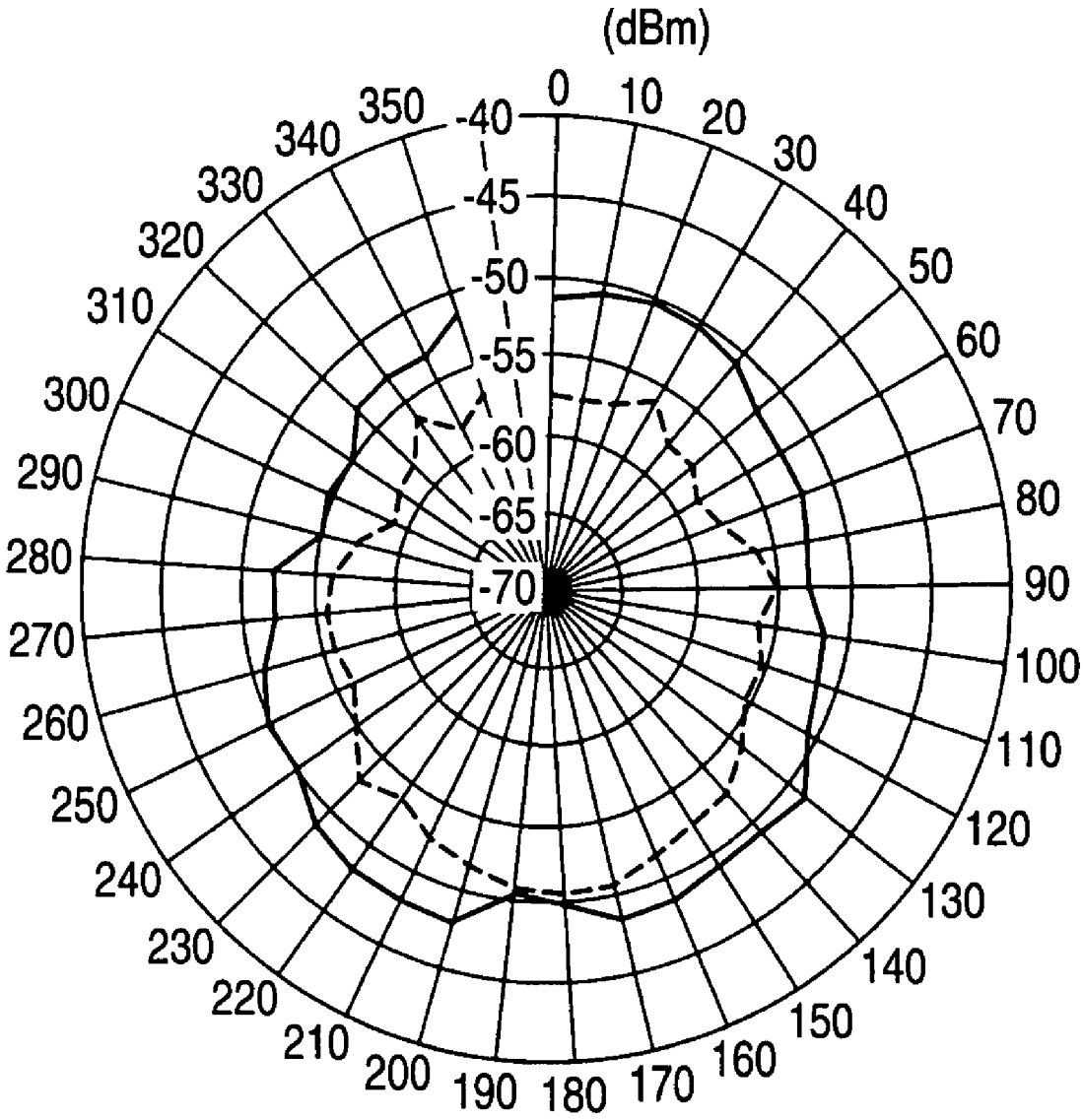
FIG. 6 is a diagram showing experimental results of Test Example 1.

Shown in FIG. 6 are results of the measurements of the antenna samples 10*a* and 10*b*. In FIG. 6, the radiation intensity from the antenna sample 10*a* containing the nonmagnetic metal powder in the first resin layer 24 and the second resin layer 26 is indicated by a thick line, and the radiation intensity from the antenna sample 10*b* containing the magnetic metal powder in the first resin layer 24 and the second resin layer 26 is indicated by a broken line. The radiation intensity from the antenna sample 10*a* is larger than that from the antenna sample 10*b*, and a radiation characteristic (antenna gain) of an electric wave in the UWB spectrum was deteriorated in the antenna sample 10*b* containing the magnetic metal powder in the first resin layer 24 and the second resin layer 26 due to the magnetism of the magnetic metal powder. That is, FIG. 6 shows that the radiation characteristic of the antenna 10 is improved by adding the nonmagnetic metal powder to the first resin layer 24 and the second resin layer 26.

Test Example 2

An antenna sample 10*c* and an antenna sample 10*d* were produced in the same manner as in the production method of the above-described antenna 10 except for using materials shown in Table 2 as the first resin layer 24 and the second resin layer 26.

TABLE 2

| | Resin layer of antenna sample 10c | Resin layer of antenna sample 10d |
|---|---|---|
| Metal powder component | Ni—3.5Fe—3.5B—3Mo—3Cu—3.8Si—0.5C | SUS304 |
| Magnetism of metal powder | Nonmagnetic | Nonmagnetic |
| Volumetric charge ratio | 30% | 24% |
| Metal powder production method | Gas atomizing method | Gas-water atomizing method |
| Shape of metal powder | Spherical | Flat |
| Average particle diameter | 50 μm | 20 μm |
| Resin | PPS resin | PPS resin |
| Complex relative permittivity (4 GHz) | 8.4 | 8.2 |
| tan δ (=μ''/μ') | 0 | 0 |
| tan δ (=ε''/ε') | 0.04 | 0.04 |

As shown in FIG. 5, on a turn table 80 rotatable around a vertical axis C, the antenna sample 10*c* or the antenna sample 10*d* was placed along the vertical axis C upright at a position H which is 1.2 m from the ground, and a signal having an intensity of −4 dBm and a frequency of 4 GHz was supplied to the antenna 10*d* (10*d*) from a transmitter (E4422B type: product of Agilent Technologies) 82 via a coaxial cable 84 to cause the antenna 10*c* or 10*d* to radiate a signal. Next, a horn antenna 86 for detection was supported by a column 88 at a position distant from the vertical axis by 3 m, and an intensity (dBm) of the signal received by the horn antenna 86 was measured by using a spectrum analyzer (8565E type: product of Agilent Technologies) 90. The antenna 10 was rotated about the vertical axis C in increments of 10 degrees to repeat the measurement every 10 degrees.

Figure 7:
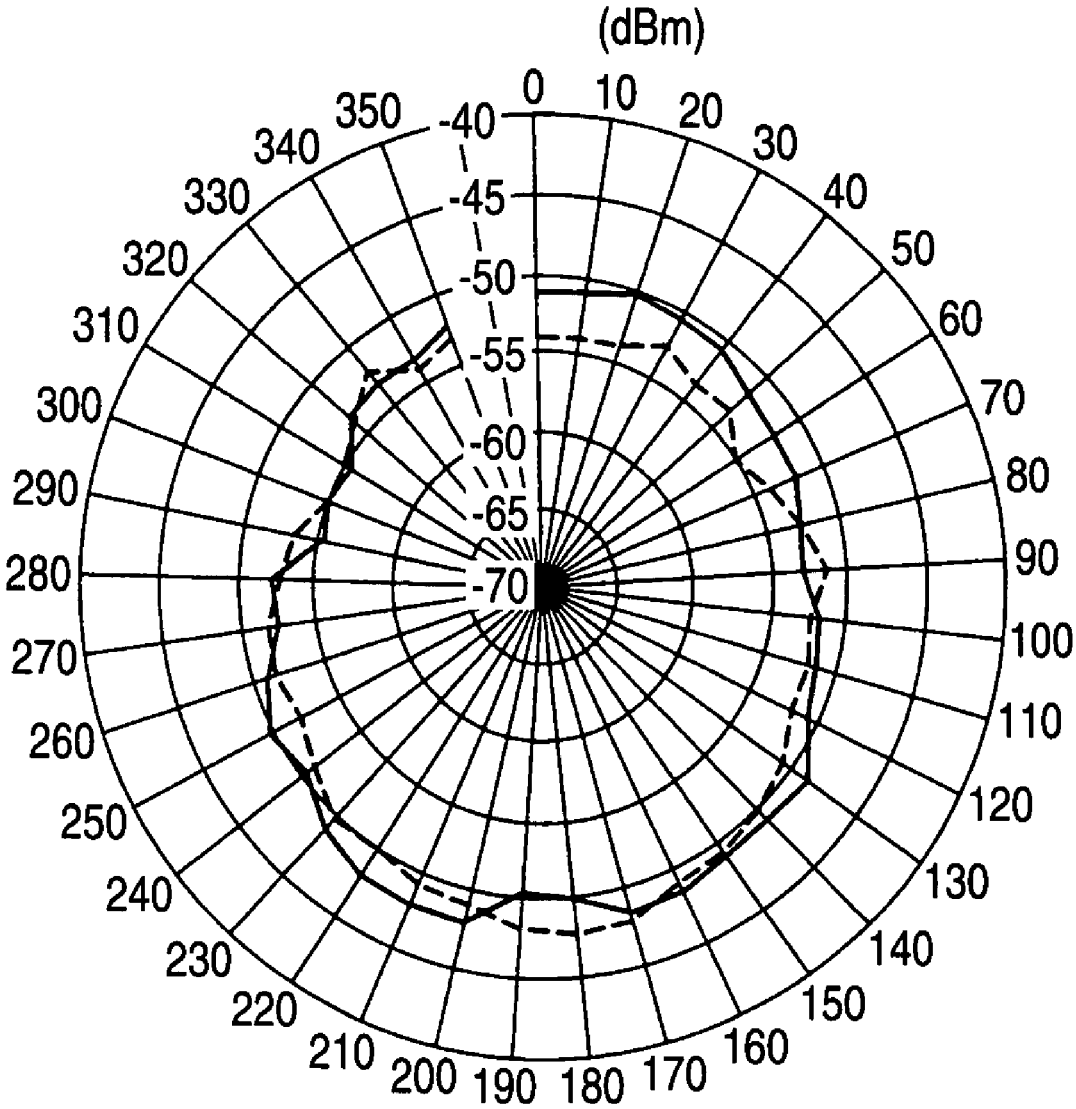
FIG. 7 is a diagram showing experimental results of Test Example 2.

Shown in FIG. 7 are results of the measurements of the antenna samples 10*c* and 10*d*. In FIG. 7, the radiation intensity from the antenna sample 10*c* containing the spherical nonmagnetic metal powder in the first resin layer 24 and the second resin layer 26 is indicated by a thick line, and the radiation intensity from the antenna sample 10*d* containing the flat nonmagnetic metal powder in the first resin layer 24 and the second resin layer 26 is indicated by a broken line. The radiation intensity from the antenna sample 10*c* is the same as that of the antenna sample 10*d*, and it was revealed that the radiation characteristics of electronic waves in the UWB spectrum are the same irrelevant from the shape and the average particle diameter of the nonmagnetic metal powder in the first resin layer 24 and the second resin layer.

Test Example 3

An antenna sample 10*e* and an antenna sample 10*f* were produced in the same manner as in the production method of the above-described antenna 10 except for using materials shown in Table 3 as the first resin layer 24 and the second resin layer 26.

TABLE 3

| | Resin layer of antenna sample 10e | Resin layer of antenna sample 10f |
|---|---|---|
| Metal powder component | SUS316 | Cu |
| Magnetism of metal powder | Nonmagnetic | Nonmagnetic |
| Volumetric charge ratio | 20% | 25% |
| Metal powder production method | Gas-water atomizing method | Gas atomizing method |
| Shape of metal powder | Spherical | Spherical |
| Average particle diameter | 24 μm | 8.2 μm |
| Resin | PPS resin | PPS resin |
| Complex relative permittivity (4 GHz) | 9.2 | 9.8 |
| tan δ (=μ''/μ') | 0 | 0 |
| tan δ (=ε''/ε') | 0.03 | 0.02 |

As shown in FIG. 5, on a turn table 80 rotatable around a vertical axis C, the antenna sample 10*e* or the antenna sample 10*f* was placed along the vertical axis C upright at a position H which is 1.2 m from the ground, and a signal having an intensity of −4 dBm and a frequency of 4 GHz was supplied to the antenna 10*e* (10*f*) from a transmitter (E4422B type: product of Agilent Technologies) 82 via a coaxial cable 84 to cause the antenna 10*e* or 10*f* to radiate a signal. Next, a horn antenna 86 for detection was supported by a column 88 at a position distant from the vertical axis by 3 m, and an intensity (dBm) of the signal received by the horn antenna 86 was measured by using a spectrum analyzer (8565E type: product of Agilent Technologies) 90. The antenna 10 was rotated about the vertical axis C in increments of 10 degrees to repeat the measurement every 10 degrees.

Figure 8:
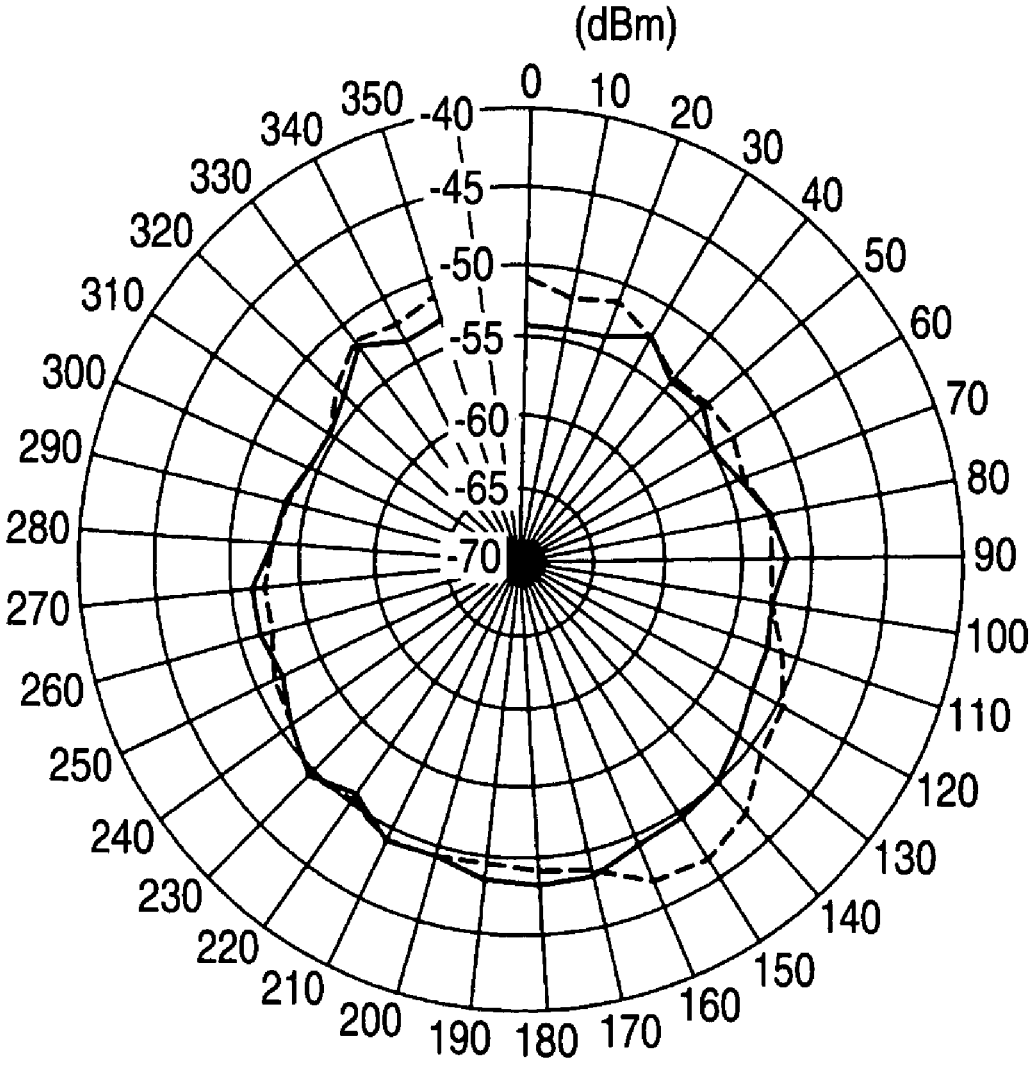
FIG. 8 is a diagram showing experimental results of Test Example 3.

Shown in FIG. 8 are results of the measurements of the antenna samples 10*e* and 10*f*. In FIG. 8, the radiation intensity from the antenna sample 10*e* containing the spherical nonmagnetic metal powder in the first resin layer 24 and the second resin layer 26 is indicated by a thick line, and the radiation intensity from the antenna sample 10*f* containing the spherical nonmagnetic metal powder in the first resin layer 24 and the second resin layer 26 is indicated by a broken line. The radiation intensity from the antenna sample 10*e* is similar to that from the antenna sample 10*f*, and it was revealed that the radiation characteristics of electronic waves in the UWB spectrum are similar to each other irrelevant from the change in average particle diameter of the nonmagnetic metal powders in the first resin layer 24 and the second resin layer 26.

Test Example 4

An antenna sample 10*g* and an antenna sample 10*h* were produced in the same manner as in the production method of the above-described antenna 10 except for using materials shown in Table 4 as the first resin layer 24 and the second resin layer 26. In Test Example 4, the metal powders were flat and had large particle diameters, and a volumetric charge ratio of the antenna sample 10*h* was increased.

TABLE 4

| | Resin layer of antenna sample 10g | Resin layer of antenna sample 10h |
|---|---|---|
| Metal powder component | SUS316 | SUS316 |
| Magnetism of metal powder | Nonmagnetic | Nonmagnetic |
| Volumetric charge ratio | 30% | 40% |
| Metal powder production method | Gas-water atomizing method | Gas atomizing method |
| Shape of metal powder | Flat | Flat |
| Average particle diameter | 46 μm | 46 μm |
| Resin | PPS resin | PPS resin |
| Complex relative permittivity (4 GHz) | 36.8 | 86.3 |
| tan δ (=μ''/μ') | 0 | 0 |
| tan δ (=ε''/ε') | 0.03 | 0.03 |

As shown in FIG. 5, on a turn table 80 rotatable around a vertical axis C, the antenna sample 10*g* or the antenna sample 10*h* was placed along the vertical axis C upright at a position H which is 1.2 m from the ground, and a signal having an intensity of −4 dBm and a frequency of 4 GHz was supplied to the antenna 10*g* (10*h*) from a transmitter (E4422B type: product of Agilent Technologies) 82 via a coaxial cable 84 to cause the antenna 10*g* or 10*h* to radiate a signal. Next, a horn antenna 86 for detection was supported by a column 88 at a position distant from the vertical axis by 3 m, and an intensity (dBm) of the signal received by the horn antenna 86 was measured by using a spectrum analyzer (8565E type: product of Agilent Technologies) 90. The antenna 10 was rotated about the vertical axis C in increments of 10 degrees to repeat the measurement every 10 degrees.

Figure 9:
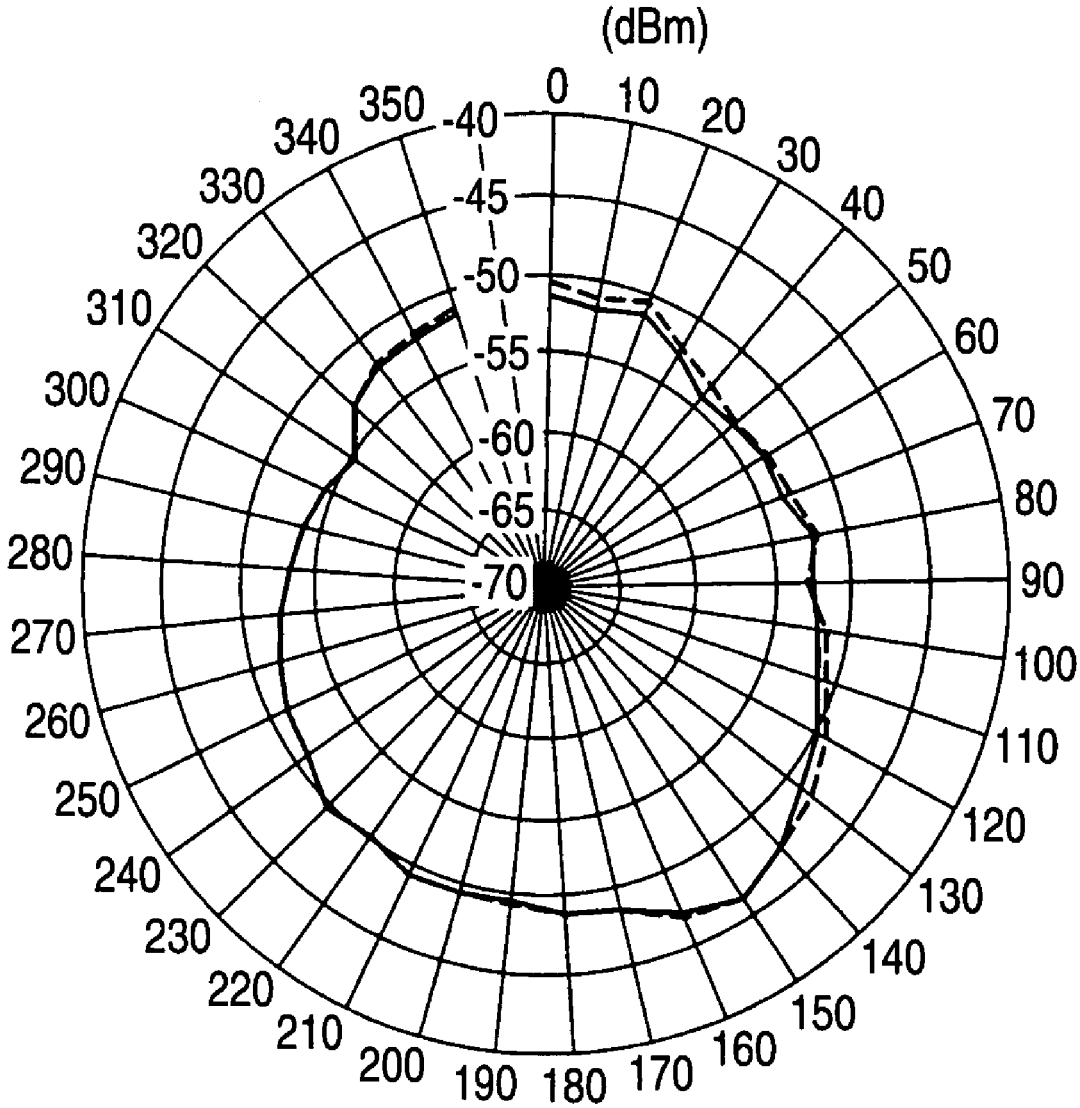
FIG. 9 is a diagram showing experimental results of Test Example 4.

Shown in FIG. 9 are results of the measurements of the antenna samples 10*g* and 10*h*. In FIG. 8, the radiation intensity from the antenna sample 10*g* containing the flat nonmagnetic metal powder in the first resin layer 24 and the second resin layer 26 is indicated by a thick line, and the radiation intensity from the antenna sample 10*h* containing the flat nonmagnetic metal powder in the first resin layer 24 and the second resin layer 26 is indicated by a broken line. The radiation intensity from the antenna sample 10*g* is similar to that from the antenna sample 10*h*, and it was revealed that the radiation characteristics of electronic waves in the UWB spectrum are similar to each other.

Test Example 5

In Test Example 5, antenna samples 10*i*, 10*j*, and 10*k* were produced by using the same materials (component of metal powder: Ni-3.5Fe-3.5B-3Mo-3Cu-3.8Si-0.5C; magnetism of metal powder: nonmagnetic; metal powder production method: gas atomizing method; metal powder average particle diameter; average particle diameter of metal powder: 50 μm; resin: PPS resin). Shapes of the antenna samples 10*i*, 10*j*, and 10*k* were the same as those of the antenna samples 10*a* and 10*c*, and volumetric charge ratios (%: volumetric ratio) of the antenna samples 10*i*, 10*j*, and 10*k* were changed from one another as showed in Table 5.

TABLE 5

| | Resin layer of sample 10i | Resin layer of sample 10j | Resin layer of sample 10k |
|---|---|---|---|
| Volumetric charge ratio | 50% | 30% | 10% |

TABLE 5-continued

| | Resin layer of sample 10i | Resin layer of sample 10j | Resin layer of sample 10k |
|---|---|---|---|
| Complex specific inductive ratio (4 GHz) | 20 | 8.4 | 7 |

Figure 10:
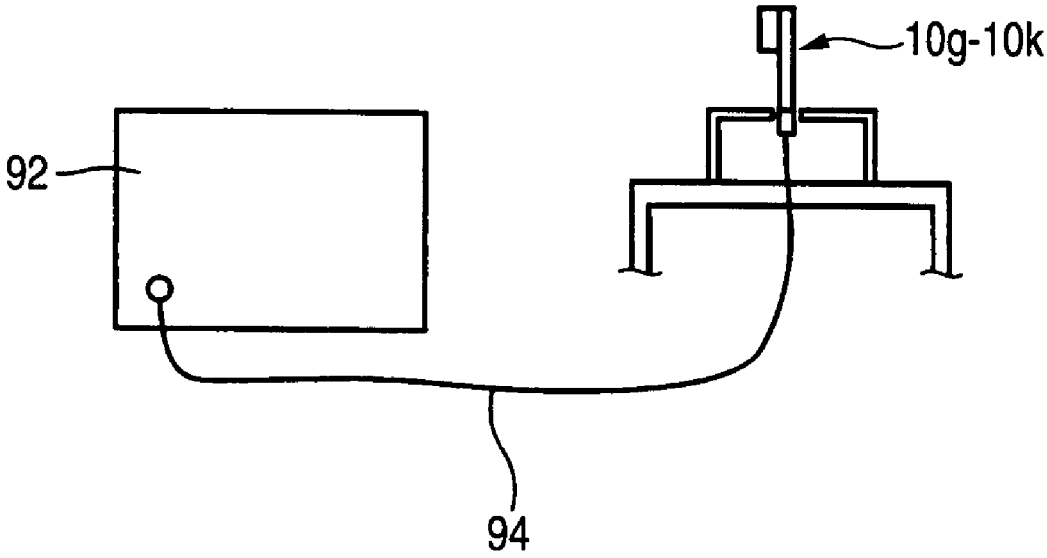
FIG. 10 is an illustration of a structure of a measurement apparatus used in Test Example 5.

As shown in FIG. 10, the antenna samples 10*i*, 10*j*, and 10*k* as well as the antenna samples 10*g* and 10*h* were mounted in the same manner as in FIG. 5, and a network analyzer (HP8510C: product of Hewlett-Packard Company) 92 was connected to the antenna 10 via a coaxial cable 94 to measure a voltage standing wave ratio (VSWR) while changing a frequency. The VSWR is a value generated due to interference between a traveling wave and a reflected wave and obtainable by dividing an absolute value |Vmax| of a maximum voltage of a standing wave on a transmission path by an absolute value |Vmin| of a maximum voltage. The smaller the value is, the smaller the reflection is and the better the antenna characteristic is.

$$VSWR=|V\max|/|V\min|=(1+|\Gamma|)/(1-|\Gamma|)$$

Figure 11:
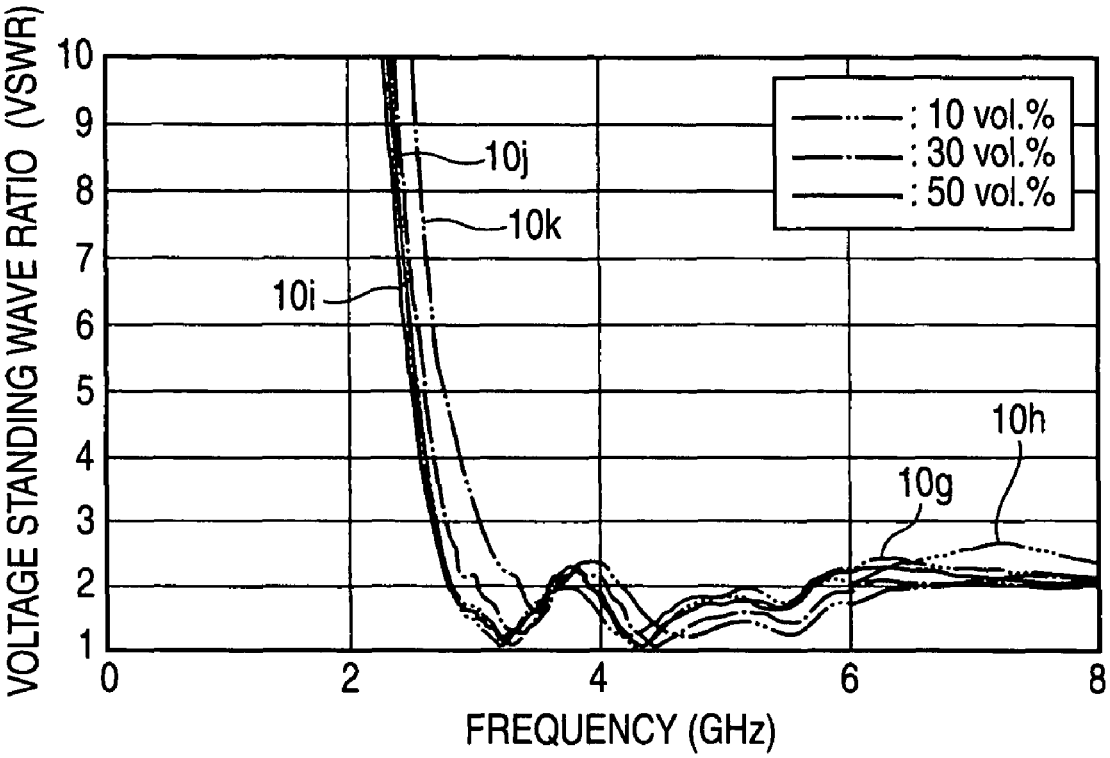
FIG. 11 is a diagram showing experimental results of Test Example 5.

In the above expression, Γ is a reflection coefficient and Γ=reflected wave voltage $V_R$/traveling wave voltage $V_F$ Shown in FIG. 11 are results of the measurement of the VSWR of the antenna samples 10*g*, 10*h*, 10*i*, 10*j*, and 10*k*. In FIG. 11: VSWR of the antenna 10*i* is indicated by a thick line; and VSWR of the antenna 10*j* is indicated by a alternate long and short dash line; VSWR of the antenna 10*k* is indicated by alternate long and two short dashes line; VSWR of the antenna 10*g* is indicated by alternate long and three short dashes line; and VSWR of the antenna 10*h* is indicated by alternate long and four short dashes line. As is apparent from FIG. 11, in the frequency region exceeding about 3 GHz, each of the antenna samples 10*g*, 10*h*, 10*i*, 10*j*, and 10*k* achieved good VSWR values of 3 or less. As shown in FIG. 11, when the frequency is 3.1 GHz which is the lower limit of the UWB, the antenna sample 10*k* exhibited the VSWR of 3 to reach the limit of the antenna performance. Also, when the ratio of the nonmagnetic metal powder exceeds 50 vol %, satisfactory molding property was not achieved to show the production limit. Therefore, it is possible to obtain the favorably low VSWR when the ratio of the nonmagnetic metal powder is 10 to 50 vol % in the first resin layer 24 and the second resin layer 26.

As described above, according to the antenna 10 of this embodiment, the antenna element is covered with the first resin layer 24 and the second resin layer 26 having the high complex specific inductive capacities since the antenna element 14 is coated with the insulating first resin layer 24 and the second resin layer 26 with which the nonmagnetic metal powder is mixed. Therefore, it is possible to largely reduce the size due to the compression of wavelength of electromagnetic wave. Also, since the nonmagnetic metal powder 50 is used, the first resin layer 24 and the second resin layer 26 are free from a loss of magnetism generated therein, thereby realizing the antenna in which the loss is maintained to a low level.

Also, according to the antenna 10 of this embodiment, since the antenna element 14 is formed of the flat conductor, and since the first resin layer 24 and the second resin layer 26 cover one surface of the antenna element 14, it is possible to make the antenna thinner as a whole, thereby achieving the downsizing. For comparison, the length and the width of the flat monopole antenna shown in Picture 2 of reference 1 is 40×30 mm, and the length and the width of the antenna 10 of this embodiment is 31×10 mm which is largely downsized.

Also, according to the antenna 10 of this embodiment, since the nonmagnetic metal powder 50 is mixed at the ratio of 10 to 50 vol % with respect to the first resin layer 24 and the second resin layer 26, the complex specific inductive capacities of the first resin layer 24 and the second resin layer 26 are favorably increased to enable the large downsizing.

Further, according to the antenna 10 of this embodiment, the antenna element 14 is formed of the flat conductor, and the first resin layer 24 and the second resin layer 26 are provided with the complex specific inductive capacities in the range of 8 to 90 in the planar direction of the flat conductor. Therefore, it is possible to achieve the wavelength compression effect, thereby realizing the largely downsized flat antenna.

Also, according to the antenna 10 of this embodiment, since the first resin layer 24 and the second resin layer 26 cover the antenna element 14 at a constant thickness and are injection-molded together with the antenna element 14 that has been placed in the die 72 in advance of the injection molding, it is possible to simultaneously perform the molding and fixing, thereby achieving the advantages of high mass productivity and low production cost.

The antenna 10 of this embodiment achieves good characteristics in the frequency band of 3 to 5 GHz that is used in the UWB communication system.

Also, according to the antenna 10 of this embodiment, since the antenna element 14 is the flat antenna (monopole type) that is connected to one end of the strip type waveguide, the antenna 10 has the advantage that it is possible to be further downsized.

Though one embodiment of this invention has been described based on the drawings in the foregoing, this invention is applicable to other modes.

For example, though the surfaces of the antenna element 14 are covered with the first resin layer 24 and the second resin layer 26 in the foregoing embodiment, it is possible to achieve the effect of downsizing when one of the surfaces of the antenna element 14 is covered with the first resin layer 24 or the second resin layer 26.

Though the shape of the antenna 10 is pentagon-shaped in the foregoing description, the shape may be another one, and the antenna 10 may be linear or comb-like.

Also, though the length L1 of the microstrip is longer than the length L2 of the antenna element 14 in the foregoing embodiment, the length L1 may be the same as the length L2 of the antenna element 14 or may be shorter than the length L2 of the antenna element 14. The lengths L1 and L2 may be changed depending on the required radiation property of the antenna element 14.

Note that the foregoing embodiment has been descried only by way of example, and it is possible to practice this invention in modes to which various alternations and modifications are added based on the knowledge of person skilled in the art.

In addition, the nonmagnetic metal powder means a metal powder having a magnetic characteristic that a loss of magnetism generated when used in the frequency band of the UWB is satisfactorily small to avoid troubles, and, even when magnetized, the magnetic substance may be used as the nonmagnetic metal powder insofar as the loss is remarkably small. In general, metal powders excluding a so-called ferromagnetic substance may be used, and gold, silver, aluminum, copper, alloys thereof, a silicon steel, and metal powders obtained by plating these metals, which are excellent in electroconductivity, may preferably be used.

The more the ratio of the nonmagnetic metal powder is increased in the resin layer, the more the nonmagnetic metal powder contributes to an increase in complex relative permittivity of the resin layer, and it is possible to add the nonmagnetic metal powder until the ratio reaches to that at which a reduction in insulating property of the resin layer starts due to contact between metal powder particles. However, when the ratio of the nonmagnetic metal powder with respect to the resin layer is less than 10 vol %, the increase in complex relative permittivity of the resin layer becomes insufficient, thereby failing to contribute to the large downsizing of the ultrawideband communication antenna. Also, when the ratio of the nonmagnetic metal powder with respect to the resin layer exceeds 50 vol %, the complex relative permittivity becomes too large to keep compatibility with the air, thereby reducing a radiation property. In terms of the complex relative permittivity of the resin layer, it is difficult to satisfactorily contribute to the downsizing when the complex relative permittivity in the planar direction of the antenna element is 8 or less. Further, the upper limit of the complex relative permittivity is set to 90 due to limitation in production. When the ratio of the nonmagnetic metal powder with respect to the resin layer exceeds 50 vol % (40 vol % when a flat powder is used), fluidity of the resin in performing the injection molding is deteriorated to prevent satisfactory molding.

Uniformity of the complex relative permittivity of the nonmagnetic metal powder tends to be reduced with a reduction in particle diameter due to distribution of dispersion. and tends to be reduced with an increase in particle diameter due to contact between particles and the like. Therefore, the particle diameter of the nonmagnetic metal powder may preferably be in the range of 3 to 100 μm. The nonmagnetic metal powder is not limited to a spherical powder and may be a flat powder. Also, the particle diameter of the nonmagnetic metal powder in this specification means an average particle diameter (D50).

The ultrawideband communication antenna is not limited to a monopole antenna and may be an antenna of a different type such as a dipole antenna, and the antenna is not necessarily a flat antenna.

A polyphenylene sulfide (PPS) resin may preferably be used for the resin layer in view of its satisfactory heat resistance to a solder welding temperature, and insulating resins such as a PET resin, an epoxy resin, a nylon resin, a polycarbonate resin, and a phenol resin that satisfy a certain strength in accordance with usage, an insulating property, heat resistance to solder welding temperature, and the like may also be used. Also, a fiber reinforced resin in which a fiber is added may be used.

The inventor of these embodiments has conducted extensive researches in view of the above-described circumstances to find that addition of a nonmagnetic metal powder to a resin for covering an antenna element makes it possible to: reduce a loss coefficient tan δ (=ε"/ε', wherein ε' and ε" are a real part and an imaginary part) of inductive capacity of the resin in a wavelength band of the UWB to 0.05; reduce a loss coefficient tan δ (=μ"/μ', wherein μ' and μ" are a real part and an imaginary part) of magnetism generated in the resin layer due to the use of the nonmagnetic metal powder; and maintain losses of the antenna to low levels. Accordingly, a specific inductive capacity of the resin layer is considerably increased to make it possible to obtain an ultrawideband communication antenna that is resistant to impact and largely reduced in size as well as possible to maintain the losses of the antenna to favorably low levels. These embodiments have been accomplished based on the above findings.

While the present invention has been described in detail and with reference to specific embodiments thereof, it will be apparent to one skilled in the art that various changes and modifications can be made therein without departing from the spirit and scope thereof.

The present application is based on Japanese Patent Application No. 2006-217588 filed on Aug. 9, 2006, Japanese Patent Application No. 2007-44784 filed on Feb. 24, 2007, and the contents thereof are incorporated herein by reference.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A ultrawideband communication antenna comprising:

an antenna element in the form of a flat conductor;

first and second insulating layers coating opposite surfaces of the antenna element, each of the insulating layers comprising resin mixed with a nonmagnetic metal powder; and a substrate, the antenna element being fixed to the substrate through one of the insulating layers;

wherein the nonmagnetic metal powder is 10 to 30 vol % of the insulating resin layer.

2. The ultrawideband communication antenna according to claim 1, wherein the insulating resin layers have a complex relative permittivity in a range of 8 to 90 in a planar direction of the conductor.

3. The ultrawideband communication antenna according to claim 1, wherein the insulating resin layers cover at least one surface of the antenna element at a constant thickness and are molded by injection together with the antenna element that has been placed in a die in advance of the injection molding.

4. The ultrawideband communication antenna according to claim 1 wherein the nonmagnetic metal powder is not a ferromagnetic metal.

5. The ultrawideband communication antenna according to claim 4 wherein the nonmagnetic metal powder is a powder of or a powder plated with a metal selected from the group consisting of gold, silver, aluminum, copper, alloys thereof and silicon steel.

6. The ultrawideband flat monopole communication antenna according to claim 1 wherein the antenna element comprises a conductor plate.

7. An ultrawide band flat monopole communication antenna comprising:

a planar substrate of width W1 and length L1 plus L2 and presenting first and second opposing planar surfaces;

first and second resin layers supported on the first surface of the substrate, each of the resin layers comprising a resin and nonmagnetic metal powder dispersed in the resin;

a flat antenna element fixed to the substrate through one of the first and second resin layers, the flat antenna element having a width W2 and length L2, and being sandwiched between the first and second resin layers, wherein W2 is less than W1; and a flat conductor element, of a width W3 and length L1, supported on the first surface of the planar substrate and connected to one end of the flat antenna element, wherein W3 is less than W2;

wherein the nonmagnetic metal powder is 10 to 30 vol % of the insulating resin layer.

8. The ultrawideband flat monopole communication antenna according to claim 7 further comprising a planar ground conductor on the second surface of the substrate.

9. The ultrawideband flat monopole communication antenna according to claim 8 wherein the planar ground conductor and the flat conductor element, with the substrate therebetween, form a waveguide.

10. The ultrawideband flat monopole communication antenna according to claim 9 wherein the planar ground conductor has a width W1 and length L1, coextensive with the flat conductor element.

11. The ultrawideband communication antenna according to claim 9 wherein the nonmagnetic metal powder is not a ferromagnetic metal.

12. The ultrawideband communication antenna according to claim 11 wherein the nonmagnetic metal powder is a powder of or a powder plated with a metal selected from the group consisting of gold, silver, aluminum, copper, alloys thereof and silicon steel.

13. The ultrawideband flat monopole communication antenna according to claim 8 wherein the planar ground conductor has a width W1 and length L1, coextensive with the flat conductor element.

14. The ultrawideband communication antenna according to claim 7 wherein the nonmagnetic metal powder is not a ferromagnetic metal.

15. The ultrawideband communication antenna according to claim 14 wherein the nonmagnetic metal powder is a powder of or a powder plated with a metal selected from the group consisting of gold, silver, aluminum, copper, alloys thereof and silicon steel.

* * * * *